US009583120B2

(12) United States Patent
Kim et al.

(10) Patent No.: US 9,583,120 B2
(45) Date of Patent: Feb. 28, 2017

(54) NOISE CANCELLATION APPARATUS AND METHOD

(71) Applicant: ELECTRONICS AND TELECOMMUNICATIONS RESEARCH INSTITUTE, Daejeon (KR)

(72) Inventors: Tae-Joong Kim, Seongnam-si (KR); Ju-Yeob Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/681,187

(22) Filed: Apr. 8, 2015

(65) Prior Publication Data

US 2015/0294667 A1 Oct. 15, 2015

(30) Foreign Application Priority Data

Apr. 9, 2014 (KR) ..... 10-2014-0042462

(51) Int. Cl.
*G10L 21/0208* (2013.01)
*G10L 21/0232* (2013.01)
(Continued)

(52) U.S. Cl.
CPC ..... *G10L 21/034* (2013.01); *G10L 21/0232* (2013.01); *G10L 21/0224* (2013.01)

(58) Field of Classification Search
CPC ..... H04R 25/505; H04R 3/005; H04R 25/453; H04R 29/006; H04R 2225/43; H04R 2410/05; H04R 1/1083; H04R 2499/11; H04R 25/407; H04R 25/50; H04R 25/552; H04R 25/70; H04R 3/002; H04R 3/04; H04R 3/02; H04R 25/356; H04R 25/502
(Continued)

(56) References Cited

U.S. PATENT DOCUMENTS 4,928,063 A * 5/1990 Lampman ..... G01R 33/3852 324/307
5,706,395 A * 1/1998 Arslan ..... G10L 21/0208 704/226
(Continued)

FOREIGN PATENT DOCUMENTS

KR 10-2005-0063995 A 6/2005

OTHER PUBLICATIONS

Dong Yu et al., "A Minimum-Mean-Square-Error Noise Reduction Algorithm on Mel-frequency Cepstra for Robust Speech Recognition", IEEE International Conference on Acoustics, Speech and Signal Processing, ICASSP, pp. 4041-4044, Mar. 31-Apr. 4, 2008.
(Continued)

*Primary Examiner* — Marivelisse Santiago Cordero
*Assistant Examiner* — Stephen Brinich
(74) *Attorney, Agent, or Firm* — Rabin & Berdo, P.C.

(57) ABSTRACT

Disclosed herein is a noise cancellation apparatus and method, which select in advance parameters to be used for noise cancellation in a reference voice signal section by generating a reference voice signal in advance before a voice signal is generated, thus improving noise cancellation effects. The noise cancellation apparatus includes a parameter initialization unit for determining an initial value of a parameter to be used for noise cancellation, based on reference signals filtered for respective frequencies, a parameter estimation unit for receiving the initial value of the parameter, and estimating the parameter in response to
(Continued)

signals that are input after being filtered for respective frequencies, a gain estimation unit for calculating gains for respective frequencies based on the parameter from the parameter estimation unit, and a gain application unit for cancelling noise by applying the gains to the signals that are input after being filtered for respective frequencies.

18 Claims, 8 Drawing Sheets

(51) Int. Cl.
*G10L 21/034* (2013.01)
*G10L 21/0224* (2013.01)

(58) Field of Classification Search
USPC ..... 704/233, 224–228, 205–210, 268
See application file for complete search history.

(56) References Cited

U.S. PATENT DOCUMENTS

| | | | | |
|---|---|---|---|---|
| 9,153,236 | B2 * | 10/2015 | Setiawan | G10L 19/012 |
| 2003/0002699 | A1 * | 1/2003 | Schulz | H04R 25/453 381/316 |
| 2003/0012388 | A1 * | 1/2003 | Ura | H04R 3/02 381/66 |
| 2008/0130711 | A1 * | 6/2008 | Catreux-Erceg | H04L 1/20 375/130 |
| 2011/0077939 | A1 | 3/2011 | Jung et al. | |
| 2011/0300806 | A1 | 12/2011 | Lindahl et al. | |

OTHER PUBLICATIONS

Vanishree Gopalakrishna et al., "Real-Time Automatic Tuning of Noise Suppression Algorithms for Cochlear Implant Applications", IEEE Transactions on Biomedical Engineering, vol. 59, Issue 6, pp. 1691-1700, Apr. 3, 2012.

* cited by examiner

NOISE CANCELLATION APPARATUS AND METHOD

CROSS REFERENCE TO RELATED APPLICATION

This application claims the benefit of Korean Patent Application No. 10-2014-0042462 filed Apr. 9, 2014, which is hereby incorporated by reference in its entirety into this application.

BACKGROUND OF THE INVENTION

1. Technical Field

The present invention generally relates to a noise cancellation apparatus and method and, more particularly, to an apparatus and method that remove noise based on voice characteristics.

2. Description of the Related Art

Since the 1950's, many technologies related to voice recognition have been developed.

Recently, with an increase in cloud-based network processing capacity, an increase in the capacity of a processor and memory for processing voice recognition, and an increase in the necessity of various user interface technologies, voice recognition has attracted attention in various application fields. Based on an increase in network processing capacity and device processing ability, various element technologies are applied, so that a voice recognition rate may be greatly improved in the processing of a natural language as well as an isolating language. By means of this, voice recognition technology may be applied even to application fields requiring the recognition of more words and phrases, and thus the application field of voice recognition technology is expanding.

To improve a voice recognition rate, methods based on various voice recognition technologies have been presented. However, a great variety of technical approaches have been made depending on language models, voice model learning and training, and database (DB) management, as well as application fields. Further, there have been extensive research and development of technology which effectively improves (from the standpoint of performance improvement and complexity reduction) a voice recognition rate by suppressing or cancelling noise contained in voice due to an environment in which voice (speech) is uttered. The present invention is focused on noise cancellation technology and is intended to make an approach to technology areas for improving a voice recognition rate.

Representative noise cancellation technology applied to voice processing (including voice recognition) includes Mel-Frequency Cepstral Coefficients-Minimum Mean Square Error (MFCC-MMSE) technology.

A device to which MFCC-MMSE noise cancellation technology is applied may include a frequency conversion unit for receiving a voice signal in a time domain and converting it into a voice signal in a frequency domain; a power calculation unit for calculating signal power in the frequency domain; a Mel-frequency filter unit for performing filtering in consideration of the frequency domain weight and nonlinearity of the voice signal; a noise cancellation unit for cancelling and suppressing a noise signal by applying an MFCC-MMSE algorithm to the voice signal; an inverse frequency conversion unit for converting the domain of the voice signal using a noise-cancelled signal; a normalization unit for normalizing the received signal by reflecting the gain thereof; and a parameter extraction unit for extracting parameters required for voice recognition using a normalized signal.

Here, the noise cancellation unit is indicated by reference numeral 20 in FIG. 1, and the noise cancellation unit 20 of FIG. 1 may include a parameter estimation unit 21 for receiving signals output from the respective filter banks 10*a* to 10*n* of the Mel-frequency filter unit 10 and estimating parameters based on the power (variance) of noise, phase, and voice signals; a gain estimation unit 22 for calculating a MFCC-MMSE gain using the estimated parameters; and a gain application unit 23 for receiving the output signal of the Mel-frequency filter unit 10 and the MFCC-MMSE gain estimated by the gain estimation unit 22 and then performing noise cancellation.

Meanwhile, a noise estimation procedure performed by the parameter estimation unit 21 will be described in detail with reference to the flowchart of FIG. 2.

First, the power of signals and power of noise are extracted (estimated) at step S10.

Then, whether to update noise is determined at step S12. For example, the ratio of signal power calculated in a current frame to the minimum value of signal power is calculated and is compared with a preset threshold value, and then it is determined whether to update noise, based on the results of comparison.

That is, when the ratio of signal power to the minimum value of signal power is equal to or greater than the threshold value, a current section is determined to be a section in which a voice signal is present, and previously estimated noise power is utilized without change at step S14.

In contrast, when the ratio of signal power to the minimum value of signal power is less than the threshold value, the current section is determined to be a section in which a voice signal is not present, and noise power is updated using noise power estimated in a previous frame and noise power calculated in a current frame at step S16.

By means of this scheme, noise power of the current frame is finally determined at step S18.

Here, when a procedure performed at step S12 of determining whether to update noise based on the signal power ratio is represented by an equation, it may be given by the following Equation (1):

$$\frac{|\dddot{m}_y(b)|_t^2}{|\dddot{m}_n(b)|_{min}^2} > \vartheta \tag{1}$$

In Equation (1), $|\dddot{m}_y(b)|_t^2$, denotes signal power calculated in the current frame and $|\dddot{m}_n(b)|_{min}^2$ denotes the minimum value of signal power. $\vartheta$ denotes a threshold value and is a preset parameter.

Further, when a signal greater than the minimum value by a predetermined ratio is measured, the current section is determined to be a section in which a voice signal is present. That is, since noise power measured in the current frame has an estimated error, the previously estimated noise power is utilized without change. This operation is represented by the following Equation (2):

$$\sigma_n^2(b)_{t-1}=\sigma_n^2(b)_{t-1} \tag{2}$$

Meanwhile, when a signal less than the minimum value by a predetermined ratio is measured, the current section is determined to be a section in which the voice signal is not present, and thus noise power is calculated using the noise power measured in the current frame and the noise power estimated in the previous frame. When this operation is represented by an equation, it may be given by the following Equation (3):

$$\sigma_n^2(b)_t=\alpha\sigma_n^2(b)_{t-1}+(1-\alpha)|m_y(b)|_t^2 \quad (3)$$

where $\alpha$ denotes a coefficient (forgetting factor) used to filter noise power estimated in the previous frame and noise power calculated in the current frame and has a value ranging from [0, 1].

However, a noise power estimation technique in the conventional noise cancellation method estimates the noise power of the current frame using the noise power of the previous frame, thus greatly influencing the entire noise cancellation performance depending on which value is to be set to an initial value of noise power. Therefore, a procedure of determining initial noise power most suitable for a current environment in which voice processing is performed is required.

Further, the conventional noise cancellation method utilizes an Infinite Impulse response (IIR) filter that uses the noise power of a previous frame and noise power calculated in a current frame in a section, in which a voice signal is not present, in order to estimate noise power. As an estimation coefficient (forgetting factor) used at this time, an experimentally determined fixed value is used. In this way, when the fixed forgetting factor is used, there is a problem in that it is difficult to effectively cope with noise characteristics (noise power variation or the like) in various environments. That is, when a forgetting factor of a very large value ($\approx 1$) is used in an environment in which noise varies very sharply, it is difficult to track rapidly varying noise power. In contrast, when a forgetting factor of a very small value ($\approx 0$) is used in an environment in which noise varies very slowly, a noise estimation error increases, thus negatively influencing noise cancellation performance.

Therefore, in noise cancellation technology for voice processing, there is required a method and apparatus capable of maximizing noise cancellation performance by setting parameters such as an initial noise power value and an IIR filter coefficient to values optimized for an environment.

As related preceding technology, U.S. Patent Application Publication No. 2011-0300806 (entitled "User-Specific Noise Suppression for Voice Quality Improvements") discloses technology in which an application device used by a single user, such as a cellular phone, improves the performance of voice recognition by performing noise suppression based on the voice features of the user.

As another related preceding technology, there is provided technology related to methods of estimating signal and noise levels because the most important factor upon selecting noise cancellation parameters is to estimate signal and noise levels. That is, as such a method, technology for estimating parameters when a voice signal is not present, and utilizing a fixed value when a voice signal is present is published in a paper by Dong Yu, Li Deng, Jasha Droppo, Jian Wu, Yifan Gong, and Alex Acero, "A Minimum-Mean-Square-Error Noise Reduction Algorithm on Melfrequency Cepstra for Robust Speech Recognition", ICASSP 2008 1-4244-1484-9/pp.4014-4044.

As further related preceding technology, technology for improving Cochlear Implant (CI) adaptability to background noise by performing noise suppression adaptively to an environment so as to prevent the performance of CI from being degraded in a noise environment is published in a paper by Vanishree Gopalakrishna, Nasser Kehtarnavaz, Taher S. Mirzahasanloo, "Real-Time Automatic Tuning of Noise Suppression Algorithms for Cochlear Implant Applications", IEEE Trans. on Biomedical Engineering Vol.00, No.00, 2012.

SUMMARY OF THE INVENTION

Accordingly, the present invention has been made keeping in mind the above problems occurring in the prior art, and an object of the present invention is to provide a noise cancellation apparatus and method, which select in advance parameters to be used for noise cancellation in a reference voice signal section by generating a reference voice signal in advance before a voice signal is generated, thus improving noise cancellation effects.

Another object of the present invention is to provide an apparatus and method that dynamically estimate parameters in a voice processing section upon applying noise cancellation technology based on voice features, and enable fast tracking of an estimated value by setting limited multiple levels, thus improving noise cancellation effects.

In accordance with an aspect of the present invention to accomplish the above objects, there is provided a noise cancellation apparatus, including a parameter initialization unit for determining an initial value of a parameter to be used for noise cancellation, based on reference signals filtered for respective frequencies; a parameter estimation unit for receiving the initial value of the parameter from the parameter initialization unit, and estimating the parameter in response to signals that are input after being filtered for respective frequencies; a gain estimation unit for calculating gains for respective frequencies based on the parameter from the parameter estimation unit; and a gain application unit for cancelling noise by applying the gains from the gain estimation unit to the signals that are input after being filtered for respective frequencies.

The signals that are input after being filtered for respective frequencies may be signals in a voice signal section other than a section in which the reference signals are present, and the parameter estimation unit may dynamically determine a forgetting factor based on noise power estimated in response to the signals that are input after being filtered for respective frequencies.

The parameter estimation unit may be configured to, when a ratio of signal power calculated in a current frame to a minimum value of signal power is less than a preset threshold value, determine the forgetting factor using both noise power estimated in a previous frame and noise power calculated in the current frame.

The parameter estimation unit may be configured to decrease the forgetting factor when an absolute value of a difference between the noise power estimated in the previous frame and the noise power calculated in the current frame is equal to or greater than a preset threshold value.

The parameter estimation unit may calculate a forgetting factor of the current frame by cumulatively adding a forgetting factor variation, obtained due to a decrease in the forgetting factor, to a forgetting factor used in the previous frame, and update noise power using the calculated forgetting factor of the current frame.

The parameter estimation unit may be configured to increase the forgetting factor when the absolute value of the difference between the noise power estimated in the previous frame and the noise power calculated in the current frame is less than the preset threshold value.

The parameter estimation unit may calculate a forgetting factor of the current frame by cumulatively adding a forgetting factor variation, obtained due to an increase in the forgetting factor, to a forgetting factor used in the previous frame, and update noise power using the calculated forgetting factor of the current frame.

The parameter estimation unit may be configured to, when the signals that are input after being filtered for respective frequencies are continuously input and then the noise power is not updated, decrease the forgetting factor based on duration of continuous input.

The parameter estimation unit may be configured to, when a ratio of signal power calculated in a current frame to a minimum value of signal power is equal to or greater than a preset threshold value, utilizing previously estimated noise power.

The parameter initialization unit may be operated in a section in which the reference signals are present, thus determining the initial value of the parameter.

In accordance with another aspect of the present invention to accomplish the above objects, there is provided a noise cancellation method, including determining, by a parameter initialization unit, an initial value of a parameter to be used for noise cancellation, based on reference signals filtered for respective frequencies; receiving, by a parameter estimation unit, the initial value of the parameter, and estimating the parameter in response to signals that are input after being filtered for respective frequencies; calculating, by a gain estimation unit, gains for respective frequencies based on the estimated parameter; and cancelling, by a gain application unit, noise by applying the calculated gains to the signals that are input after being filtered for respective frequencies.

The signals that are input after being filtered for respective frequencies may be signals in a voice signal section other than a section in which the reference signals are present, and estimating the parameter may include dynamically determining a forgetting factor based on noise power estimated in response to the signals that are input after being filtered for respective frequencies.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
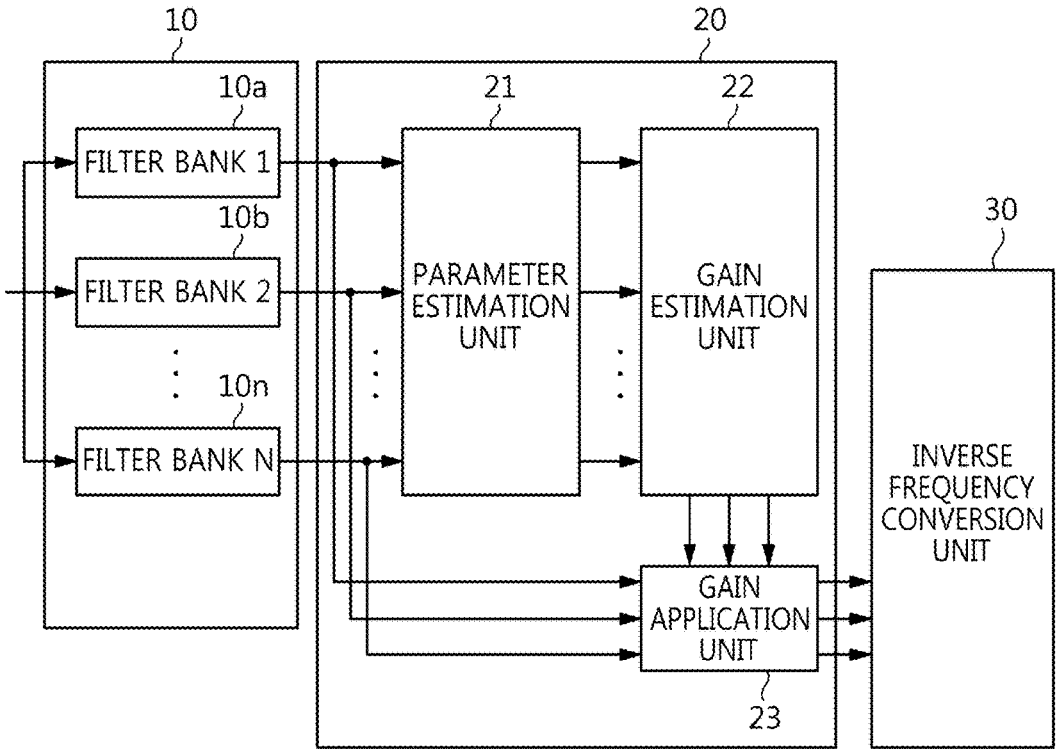
FIG. 1 PRIOR ART
FIG. 1 is a configuration diagram showing the internal configuration of a conventional noise cancellation unit using MFCC-MMSE.
Figure 2:
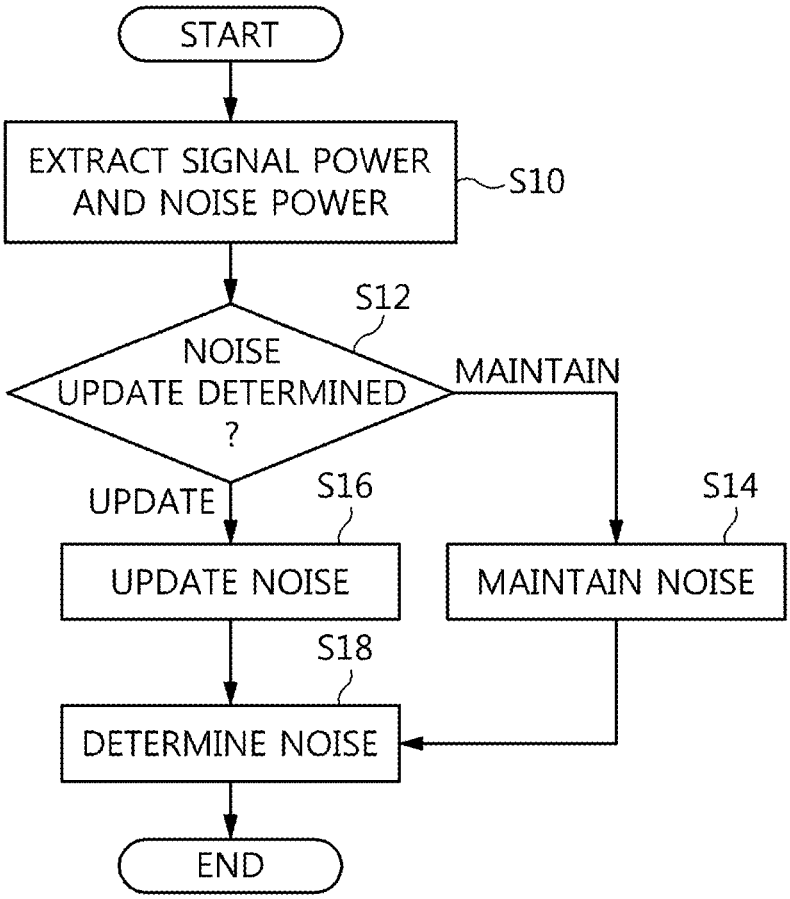
FIG. 2 PRIOR ART
FIG. 2 is a flowchart describing a noise estimation procedure performed by the noise cancellation unit of FIG. 1.

The present invention may be variously changed and may have various embodiments, and specific embodiments will be described in detail below with reference to the attached drawings.

However, it should be understood that those embodiments are not intended to limit the present invention to specific disclosure forms and they include all changes, equivalents or modifications included in the spirit and scope of the present invention.

The terms used in the present specification are merely used to describe specific embodiments and are not intended to limit the present invention. A singular expression includes a plural expression unless a description to the contrary is specifically pointed out in context. In the present specification, it should be understood that the terms such as "include" or "have" are merely intended to indicate that features, numbers, steps, operations, components, parts, or combinations thereof are present, and are not intended to exclude a possibility that one or more other features, numbers, steps, operations, components, parts, or combinations thereof will be present or added.

Unless differently defined, all terms used here including technical or scientific terms have the same meanings as the terms generally understood by those skilled in the art to which the present invention pertains. The terms identical to those defined in generally used dictionaries should be interpreted as having meanings identical to contextual meanings of the related art, and are not interpreted as being ideal or excessively formal meanings unless they are definitely defined in the present specification.

Embodiments of the present invention will be described in detail with reference to the accompanying drawings. In the following description of the present invention, the same reference numerals are used to designate the same or similar elements throughout the drawings and repeated descriptions of the same components will be omitted.

Figure 3:
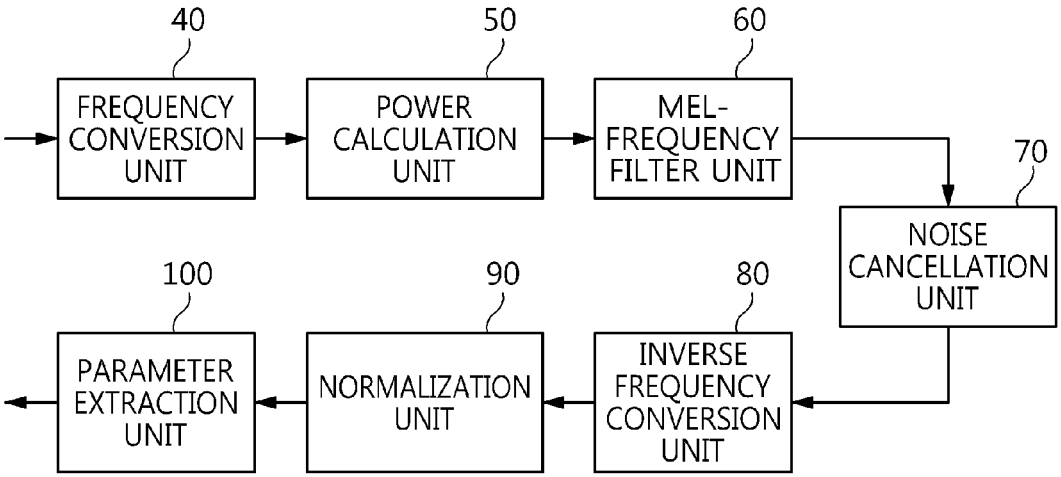
FIG. 3 is a configuration diagram of a system employing a noise cancellation apparatus according to an embodiment of the present invention.

FIG. 3 is a configuration diagram of a system employing a noise cancellation apparatus according to an embodiment of the present invention.

The system shown in FIG. 3 includes a frequency conversion unit 40, a power calculation unit 50, a Mel-frequency filter unit 60, a noise cancellation unit 70, an inverse frequency conversion unit 80, a normalization unit 90, and a parameter extraction unit 100. The noise cancellation unit 70, which will be described later, may be an example of a noise cancellation apparatus desired to be implemented in the present invention.

The frequency conversion unit 40 receives a voice signal in a time domain and converts it into a voice signal in a frequency domain. For example, the frequency conversion unit 40 may divide the received time-domain voice signal into frames and individually convert respective time-domain frames into frequency-domain frames.

The power calculation unit 50 calculates signal power values of the respective frequency-domain frames provided from the frequency conversion unit 40.

The Mel-frequency filter unit 60 performs filtering in consideration of the frequency-domain weight and nonlinearity of the voice signal. The Mel-frequency filter unit 60 includes a plurality of filter banks. Here, the plurality of filter banks denote a filter group that is used when the frequency band of the voice signal is divided using a plurality of band-pass filters, and voice analysis is performed using the outputs of the filters. Accordingly, the Mel-frequency filter unit 60 filters input signals for respective frequencies using a plurality of Mel-scale filter banks. That is, the Mel-frequency filter unit 60 passes only signals corresponding to the frequency bands of the respective filter banks therethrough. In this way, the Mel-frequency filter unit 60 outputs filtered signals for respective frequencies (e.g., those signals may be regarded as MFCC (voice feature data)).

The noise cancellation unit 70 receives signals for respective frequencies that are filtered on a frame basis from the Mel-frequency filter unit 60, and initializes parameters and estimates dynamic parameters based on the signals for respective frequencies that are filtered on a frame basis. Further, the noise cancellation unit 70 cancels and suppresses noise signals by applying an MFCC-MMSE algorithm to the signals.

The inverse frequency conversion unit 80 converts back the domain of the noise-cancelled signals output from the noise cancellation unit 70. That is, the noise-cancelled signals from the noise cancellation unit 70 are frequency-domain signals and are converted into time-domain signals by the inverse frequency conversion unit 80.

The normalization unit 90 normalizes signals input from the inverse frequency conversion unit 80 by incorporating gains into the input signals.

The parameter extraction unit 100 extracts parameters required for voice recognition using the signals normalized by the normalization unit 90.

Figure 4:
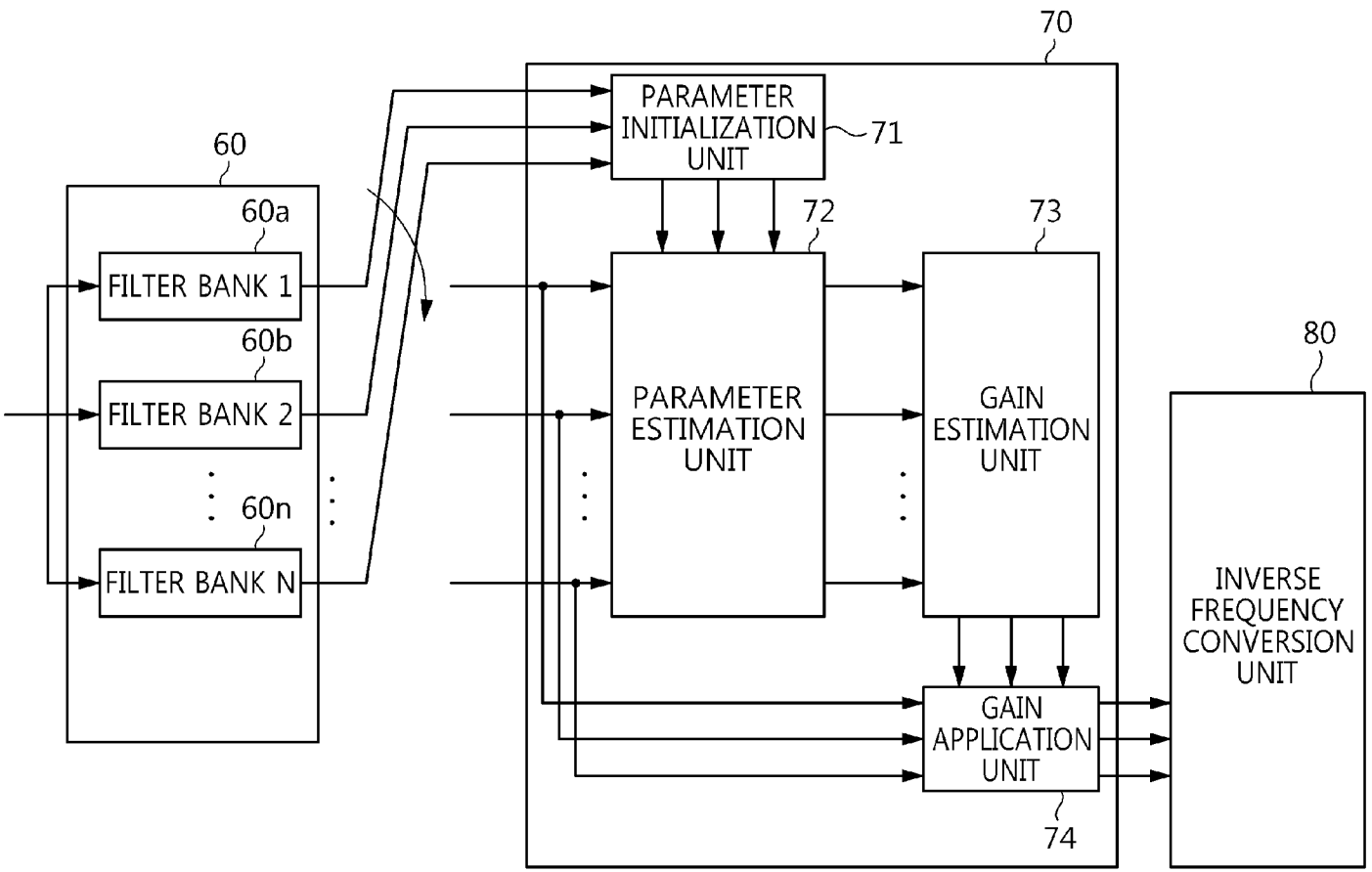
FIG. 4 is a configuration diagram showing the internal configuration of the noise cancellation apparatus shown in FIG. 3.

FIG. 4 is a configuration diagram showing the internal configuration of the noise cancellation apparatus shown in FIG. 3.

The noise cancellation unit 70 includes a parameter initialization unit 71, a parameter estimation unit 72, a gain estimation unit 73, and a gain application unit 74.

The parameter initialization unit 71 receives reference signals output from the respective filter banks 60*a* to 60*n* of the Mel-frequency filter unit 60 and determines the initial values of parameters based on the power (variance) of noise, phase, and voice signals. That is, the parameter initialization unit 71 is operated only for the reference signals, and does not perform a separate operation in a normal voice signal section. In other words, in an embodiment of the present invention, reference signals are designated to be loaded in a section preceding a normal voice signal section and to be input to the parameter initialization unit 71. The parameter initialization unit 71 initializes parameters to be used for noise cancellation, based on the power of the noise, phase, and voice signals in the section in which the reference signals are present.

The parameter estimation unit 72 receives signals output from the respective filter banks 60*a* to 60*n* of the Mel-frequency filter units 60 and estimates parameters to be used to cancel noise, based on the power (variance) of noise, phase, and voice signals. That is, the parameter estimation unit 72 receives signals output from the respective filter banks 60*a* to 60*n* of the Mel-frequency filter unit 60 (i.e., signals in a normal voice signal section other than the section in which reference signals are present), and obtains power (variance) of noise, phase, and voice signals. Thereafter, the parameter estimation unit 72 may use the initial values of the parameters output from the parameter initialization unit 71 without change or may change parameter values, based on the obtained power. In other words, the parameter estimation unit 72 may adjust parameters to be used for noise cancellation.

Here, the parameter estimation unit 72 may receive the signals output from the respective filter banks 60*a* to 60*n* of the Mel-frequency filter unit 60, obtain power (variance) of noise, and dynamically determine an estimation coefficient (forgetting factor) based on the obtained power (variance). Since the forgetting factor may be dynamically set to values optimized for an environment, noise cancellation performance may be maximized.

Meanwhile, the parameter estimation unit 72 calculates the absolute value $\Delta\sigma$ of a difference between noise power estimated in a previous frame and noise power calculated in a current frame and compares the absolute value with a preset threshold value Cth, in order to receive filtered signals for respective frequencies and dynamically determine the forgetting factor based on the estimated noise power. As a result, the parameter estimation unit 72 may perform an operation of decreasing the forgetting factor when the absolute value is equal to or greater than the threshold value, and of increasing the forgetting factor when the absolute value is less than the threshold value.

Further, the parameter estimation unit 72 may store a forgetting factor variation in a previous frame and use it to calculate a forgetting factor variation in a current frame, in order to receive filtered signals for respective frequencies and dynamically vary the forgetting factor based on the estimated noise power.

Meanwhile, the parameter estimation unit 72 may cumulatively add a forgetting factor variation $\Delta C(t)$ calculated in a current frame to the forgetting factor used in a previous frame, and use a resulting forgetting factor as a current forgetting factor C(t), in order to receive filtered signals for respective frequencies and dynamically vary the forgetting factor based on the estimated noise power.

Furthermore, the parameter estimation unit 72 may reduce the forgetting factor based on the duration of a voice signal when the voice signal is continuously input and noise update is not performed, in order to receive filtered signals for respective frequencies and dynamically vary the forgetting factor based on the estimated noise power.

The gain estimation unit 73 calculates MFCC-MMSE gains using the parameters estimated by the parameter estimation unit 72. That is, the gain estimation unit 73 may calculate (estimate) gains for respective frequencies in each frame, based on the estimated parameters.

The gain application unit 74 may perform noise cancellation by applying the gains for respective frequencies (MFCC-MMSE gains) calculated by the gain estimation unit 73 to the filtered signals for respective frequencies output from the Mel-frequency filter unit 60. That is, the gain application unit 74 uses the gains for respective frequencies (MFCC-MMSE gains) as compensation values, and compensates for the filtered signals for respective frequencies of the Mel-frequency filter unit 60, thus performing noise cancellation.

Figure 5:
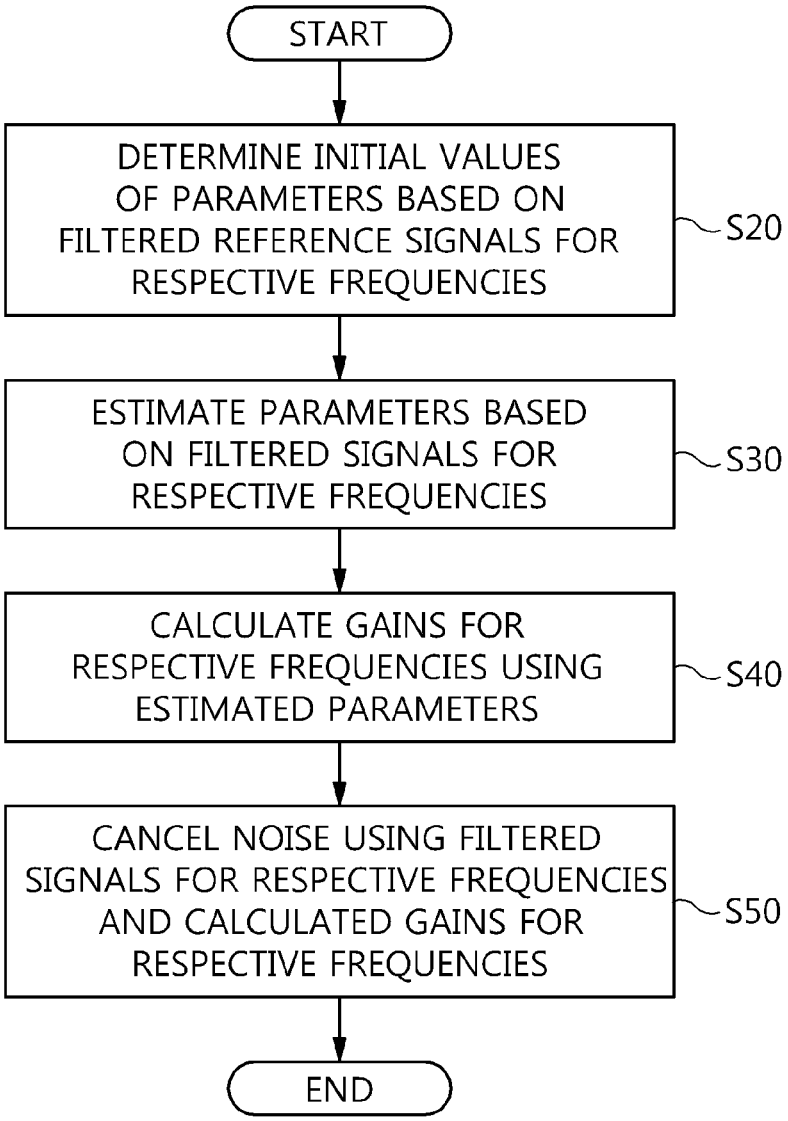
FIG. 5 is a flowchart showing a noise cancellation method according to an embodiment of the present invention.

FIG. 5 is a flowchart showing a noise cancellation method according to an embodiment of the present invention.

First, at step S20, the parameter initialization unit 71 receives reference signals from the respective filter banks 60*a* to 60*n* of the Mel-frequency filter unit 60. Then, the parameter initialization unit 71 detects (extracts) the power (variance) of noise, phase, and voice signals from the received reference signals of the respective filter banks 60*a* to 60*n*, and determines initial values of parameters based on the power (variance). That is, the parameter initialization unit 71 initializes the parameters based on the power of the noise, phase, and voice signals in a section in which reference signals are present.

Thereafter, at step S30, the parameter estimation unit 72 receives signals output from the respective filter banks 60*a* to 60*n* of the Mel-frequency filter unit 60. The parameter estimation unit 72 estimates the parameters via the power (variance) of noise, phase, and voice signals in the received signals of the respective filter banks 60*a* to 60*n*. For example, based on the power (variance) of the noise, phase, and voice signals, the parameter estimation unit 72 may use the initial parameter values from the parameter initialization unit 71 without change, or may change the parameter values.

Further, at step S40, the gain estimation unit 73 calculates MFCC-MMSE gains (gains for respective frequencies) in each frame using the parameters estimated by the parameter estimation unit 72.

Finally, at step S50, the gain application unit 74 uses the gains for respective frequencies (MFCC-MMSE gains) as compensation values, and compensates for the filtered signals for respective frequencies output from the Mel-frequency filter unit 60, thus performing noise cancellation.

Figure 6:
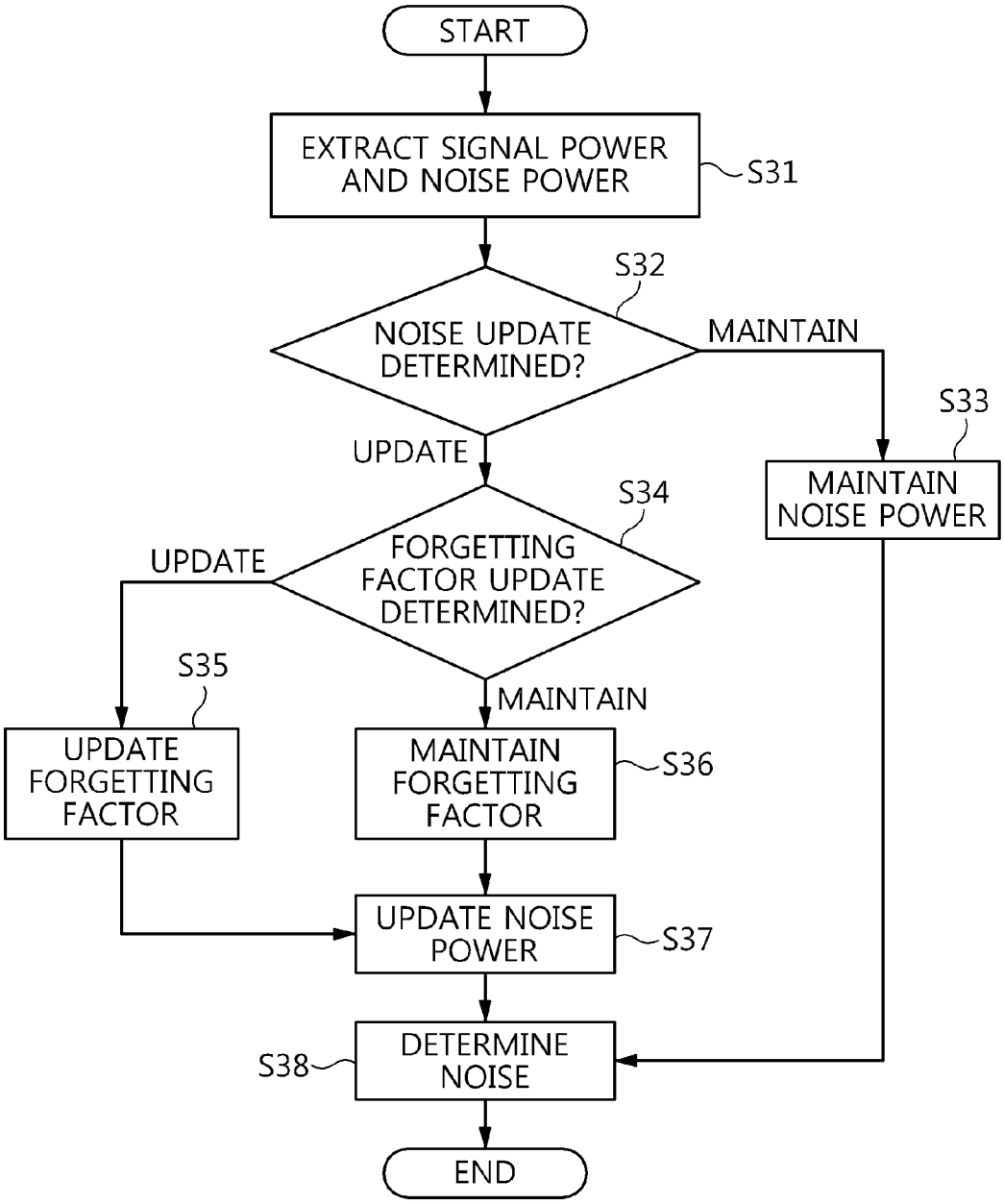
FIG. 6 is a flowchart showing an example of a noise estimation procedure in the noise cancellation method according to the embodiment of the present invention.

FIG. 6 is a flowchart showing an example of a noise estimation procedure in the noise cancellation method according to the embodiment of the present invention. The following description will be regarded as an example of a noise estimation procedure performed by the parameter estimation unit 72.

First, power values of signals and noise output from the respective filter banks 60*a* to 60*n* of the Mel-frequency filter unit 60 are estimated (extracted) at step S31.

Then, whether to update noise is determined. In this case, the ratio of the power of a signal calculated in a current frame to the minimum value of signal power is calculated, and is compared with a preset threshold value at step S32.

If the ratio of the signal power calculated in the current frame to the minimum value of signal power is equal to or greater than the threshold value, a current section is determined to be a section in which a voice signal is present, and thus previously estimated noise power is utilized as noise without change at step S33.

In contrast, if the ratio of the signal power calculated in the current frame to the minimum value of signal power is less than the threshold value, the current section is determined to be a section in which a voice signal is not present, and thus a forgetting factor update determination procedure is performed to determine a forgetting factor required to update noise power by using both noise power estimated in a previous frame and noise power calculated in a current frame at step S34.

In the above-described forgetting factor update determination, the absolute value $\Delta\sigma$ of a difference between the noise power estimated in the previous frame and the noise power calculated in the current frame is calculated, and is compared with a preset threshold value Cth.

If the absolute value is equal to or greater than the threshold value, a difference between the noise of the previous frame and the noise of the current frame is large, and thus the forgetting factor must be decreased so that the estimated value may be rapidly tracked. That is, a forgetting factor update is performed at step S35, wherein a forgetting factor variation $\Delta C(t)$ is decreased by subtracting a unit level N from a previous forgetting factor variation $\Delta C(t-1)$. This operation may be represented by the following Equation (4):

$$\Delta C(t)=\Delta C(t-1)-N \text{ for } \Delta\sigma\geq Cth \quad (4)$$

In contrast, when the absolute value is less than the threshold value Cth, a difference between the noise of the previous frame and the noise of the current frame is not large, and thus the forgetting factor must be increased so that the estimated value may be tracked slowly. That is, a forgetting factor update is performed at step S35, wherein the forgetting factor variation $\Delta C(t)$ is increased by adding a unit level N to the previous forgetting factor variation $\Delta C(t-1)$. This operation may be represented by the following Equation (5):

$$\Delta C(t)=\Delta C(t-1)+N \text{ for } \Delta\sigma<Cth \quad (5)$$

Meanwhile, although the threshold values used in Equations (4) and (5) are designated to have the same value Cth, these values may be different values. For example, Cth,1 may be used in Equation (4), and Cth,2 may be used in Equation (5). Here, Cth,1 may have a larger value than Cth,2. Then, $\Delta\sigma$ may satisfy the following conditions:

1) $\Delta\sigma\geq$Cth,1
2) Cth,2$\leq\Delta\sigma<$Cth,1
3) $\Delta\sigma<$Cth,2

Then, the forgetting factor variation $\Delta C(t)$ may be decreased in condition 1), the forgetting factor variation $\Delta C(t)$ may be increased in condition 3), and the forgetting factor variation $\Delta C(t)$ may be maintained in condition 2). Here, in conditions 1) and 3), the above-described forgetting factor update is performed, but in condition 2), the forgetting factor is maintained at step S36.

The forgetting factor variation $\Delta C(t)$ calculated as described above is cumulatively added to the forgetting factor used in the previous frame, and then the forgetting factor C(t) of the current frame is calculated. This operation may be represented by the following Equation (6):

$$C(t)=C(t-1)+\Delta C(t) \quad (6)$$

Using the forgetting factor of the current frame calculated in this way, noise power is updated at step S37.

In this way, the noise of the current frame is determined (estimated) at step S38.

Figure 7:
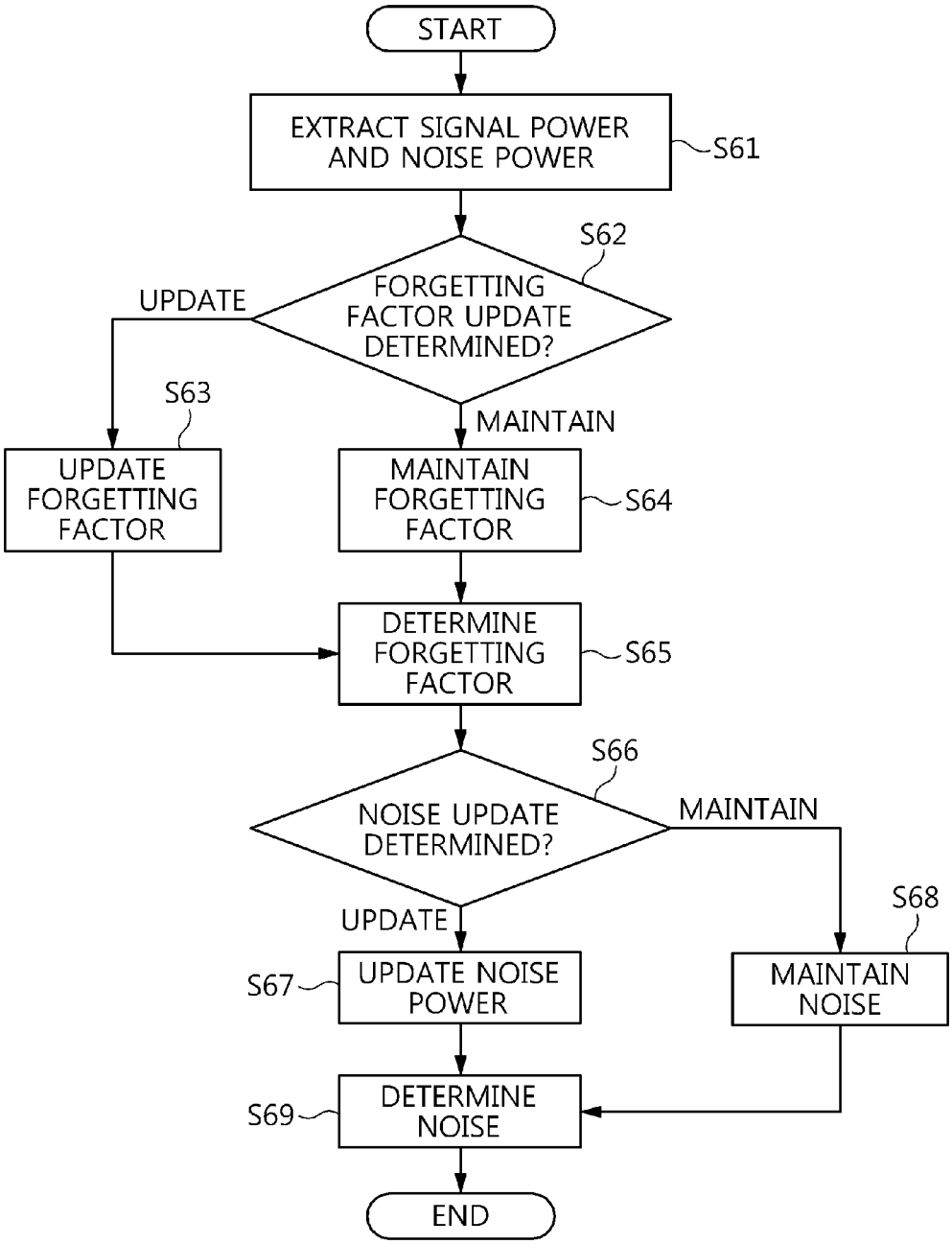
FIG. 7 is a flowchart showing another example of a noise estimation procedure in the noise cancellation method according to the embodiment of the present invention.

FIG. 7 is a flowchart showing another example of a noise estimation procedure in the noise cancellation method according to the embodiment of the present invention. The following description may be regarded as another example of a noise estimation procedure performed by the parameter estimation unit 72. For example, power values of signals and noise output from the respective filter banks 60*a* to 60*n* of the Mel-frequency filter unit 60 are estimated (extracted) at step S61.

Then, whether to update a forgetting factor is determined. In this case, the absolute value $\Delta\sigma$ of a difference between noise power estimated in a previous frame and noise power calculated in a current frame is calculated, and the calculated absolute value is compared with a preset threshold value at step S62.

If the absolute value is equal to or greater than the threshold value, the difference between the noise of the previous frame and the noise of the current frame is large, and thus the forgetting factor must be decreased so that an estimated value may be rapidly tracked. That is, a forgetting factor update is performed at step S63, wherein the forgetting factor variation $\Delta C(t)$ is decreased by subtracting a unit level N from the previous forgetting factor variation $\Delta C(t-1)$. This operation may be represented by the above-described Equation (4).

In contrast, if the absolute value is less than the threshold value Cth, a difference between the noise of the previous frame and the noise of the current frame is not large, and thus the forgetting factor must be increased so that the estimated value may be tracked slowly. That is, a forgetting factor update is performed at step S63, wherein the forgetting factor variation $\Delta C(t)$ is increased by adding a unit level N to the previous forgetting factor variation $\Delta C(t-1)$. This operation may be represented by the above-described Equation (5).

Further, forgetting factor maintenance step S64 may be regarded as being identical to the above-described step S36 of FIG. 6.

The forgetting factor variation ΔC(t) calculated in this way is cumulatively added to the forgetting factor used in the previous frame, and then the forgetting factor C(t) of the current frame is determined (calculated) at step S65. This operation may be represented by the above-described Equation (6).

Thereafter, whether to update noise in the current frame is determined at step S66. In this case, the ratio of signal power calculated in the current frame to the minimum value of signal power is calculated and is compared with a preset threshold value.

If the ratio of the signal power calculated in the current frame to the minimum value of signal power is equal to or greater than the threshold value, a current section is determined to be a section in which a voice signal is present, and then previously estimated noise power is utilized as noise without change at step S68.

In contrast, when the ratio of the signal power calculated in the current frame to the minimum value of signal power is less than the threshold value, the current section is determined to be a section in which a voice signal is not present. Further, noise power of the current frame is updated using the current forgetting factor C(t), determined at step S65, at step S67.

In this way, the noise of the current frame is determined (estimated) at step S69.

In the embodiment of the present invention, when a voice signal is input and a noise update is not continuously performed, it is preferable to use newly calculated noise power rather than estimating the noise power of a current frame based on previous noise, and thus such a phenomenon is reflected. That is, the parameter estimation unit 72 continuously sets the forgetting factor to a small value (M) even when voice signals (signals input after being filtered for respective frequencies by the Mel-frequency filter unit 60) are continuously input and noise power is not updated, thus enabling the forgetting factor to be immediately reflected in a noise signal when the noise signal is subsequently input. This operation may be represented by the following Equation (7):

$$C(t)=C(t-1)-M \text{ for No-update of Noise variance} \quad (7)$$

That is, in the embodiment of the present invention, the forgetting factor may be updated by including information about whether to update noise as well as a calculated difference in noise power when the forgetting factor is updated.

In accordance with the present invention having the above configuration, there is an advantage in that, upon applying noise cancellation technology based on voice features, parameters to be used for noise cancellation in a reference voice signal section are selected in advance, thus improving noise cancellation effects, and enhancing the performance of voice processing (voice recognition or the like) based on noise cancellation.

Further, there is an advantage in that, upon applying noise cancellation technology based on voice features, the present invention dynamically estimates parameters in a voice processing section, and enables fast tracking of an estimated value by setting limited multiple levels, thus improving noise cancellation effects and enhancing the performance of voice processing (voice recognition or the like) based on the noise cancellation.

Figure 8:
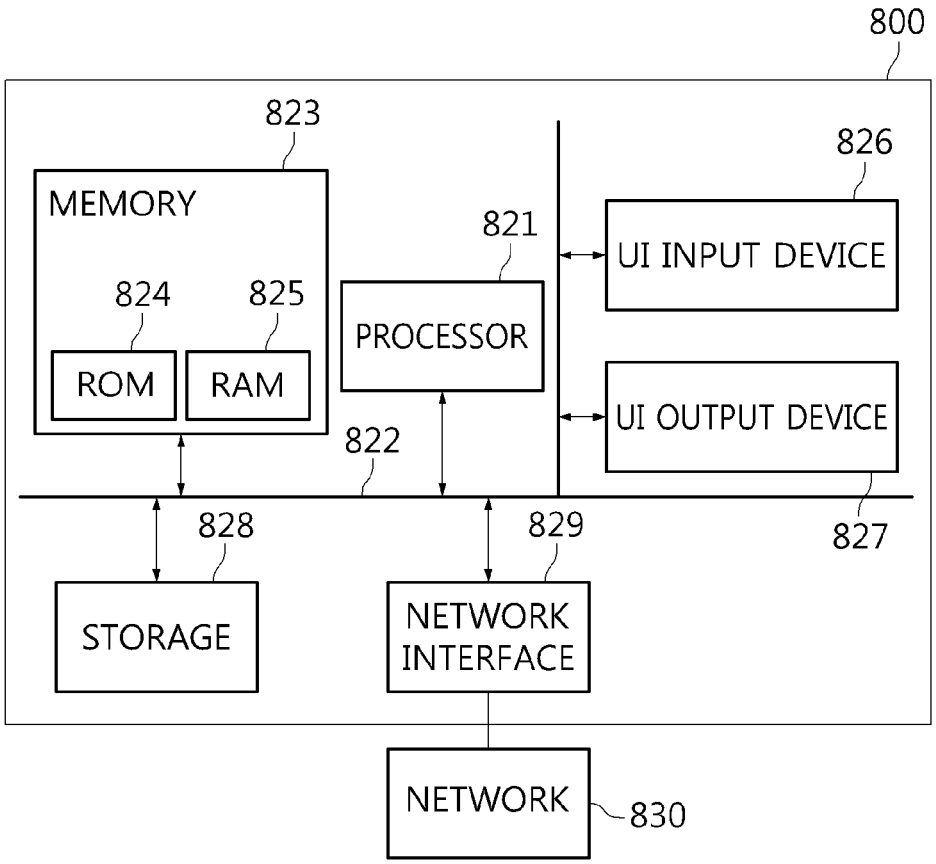
FIG. 8 illustrates a computer that implements the noise cancellation apparatus or the system employing the noise cancellation apparatus according to an example.

FIG. 8 illustrates a computer that implements the noise cancellation apparatus or the system employing the noise cancellation apparatus according to an example.

Each of the noise cancellation apparatus and the system employing the noise cancellation apparatus may be implemented as a computer 800 illustrated in FIG. 8.

Each of the noise cancellation apparatus and the system employing the noise cancellation apparatus may be implemented in a computer system including a computer-readable storage medium. As illustrated in FIG. 8, the computer 800 may include at least one processor 821, memory 823, a user interface (UI) input device 826, a UI output device 827, and storage 828 that can communicate with each other via a bus 822. Furthermore, the computer 800 may further include a network interface 829 that is connected to a network 830. The processor 821 may be a semiconductor device that executes processing instructions stored in a central processing unit (CPU), the memory 823 or the storage 828. The memory 823 and the storage 828 may be various types of volatile or nonvolatile storage media. For example, the memory may include ROM (read-only memory) 824 or random access memory (RAM) 825.

At least one unit of the noise cancellation apparatus may be configured to be stored in the memory 823 and to be executed by at least one processor 821. Functionality related to the data or information communication of the noise cancellation apparatus may be performed via the network interface 829.

At least one unit of the system employing the noise cancellation apparatus may be configured to be stored in the memory 823 and to be executed by at least one processor 821. Functionality related to the data or information communication of the system employing the noise cancellation apparatus may be performed via the network interface 829.

The at least one processor 821 may perform the above-described operations, and the storage 828 may store the above-described constants, variables and data, etc.

The methods according to embodiments of the present invention] may be implemented in the form of program instructions that can be executed by various computer means. The computer-readable storage medium may include program instructions, data files, and data structures solely or in combination. Program instructions recorded on the storage medium may have been specially designed and configured for the present invention, or may be known to or available to those who have ordinary knowledge in the field of computer software. Examples of the computer-readable storage medium include all types of hardware devices specially configured to record and execute program instructions, such as magnetic media, such as a hard disk, a floppy disk, and magnetic tape, optical media, such as compact disk (CD)-read only memory (ROM) and a digital versatile disk (DVD), magneto-optical media, such as a floptical disk, ROM, random access memory (RAM), and flash memory. Examples of the program instructions include machine code, such as code created by a compiler, and high-level language code executable by a computer using an interpreter. The hardware devices may be configured to operate as one or more software modules in order to perform the operation of the present invention, and the vice versa.

At least one embodiment of the present invention provides an operation method and apparatus for implementing a compression function for fast message hashing.

At least one embodiment of the present invention provides an operation method and apparatus for implementing a compression function that are capable of enabling message hashing while ensuring protection from attacks.

At least one embodiment of the present invention provides an operation method and apparatus for implementing a compression function that use combinations of bit operators commonly used in a central processing unit (CPU), thereby enabling fast parallel processing and also reducing the computation load of a CPU.

At least one embodiment of the present invention provides an operation method and apparatus that enable the structure of a compression function to be defined with respect to inputs having various lengths.

Although the present invention has been described in conjunction with the limited embodiments and drawings, the present invention is not limited thereto, and those skilled in the art will appreciate that various modifications, additions and substitutions are possible from this description. For example, even when described technology is practiced in a sequence different from that of a described method, and/or components, such as systems, structures, devices, units, and/or circuits, are coupled to or combined with each other in a form different from that of a described method and/or one or more thereof are replaced with one or more other components or equivalents, appropriate results may be achieved.

Therefore, other implementations, other embodiments and equivalents to the claims fall within the scope of the attached claims.

As described above, optimal embodiments of the present invention have been disclosed in the drawings and the specification. Although specific terms have been used in the present specification, these are merely intended to describe the present invention and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. A noise cancellation apparatus, comprising:

a parameter initialization unit for determining an initial value of a parameter to be used for noise cancellation, based on reference signals filtered for respective frequencies;

a parameter estimation unit for receiving the initial value of the parameter from the parameter initialization unit, and estimating the parameter in response to signals that are input after being filtered for respective frequencies;

a gain estimation unit for calculating gains for respective frequencies based on the parameter from the parameter estimation unit; and a gain application unit for cancelling noise by applying the gains from the gain estimation unit to the signals that are input after being filtered for respective frequencies, wherein the parameter estimation unit dynamically determines a forgetting factor based on noise power estimated in response to the signals that are input after being filtered for respective frequencies and estimates the parameter using the forgetting factor, and wherein the signals that are input after being filtered for respective frequencies are signals in a voice signal section other than a section in which the reference signals are present.

2. The noise cancellation apparatus of claim 1, wherein the parameter estimation unit is configured to, when a ratio of signal power calculated in a current frame to a minimum value of signal power is less than a preset threshold value, determine the forgetting factor using both noise power estimated in a previous frame and noise power calculated in the current frame.

3. The noise cancellation apparatus of claim 2, wherein the parameter estimation unit is configured to decrease the forgetting factor, when an absolute value of a difference between the noise power estimated in the previous frame and the noise power calculated in the current frame is equal to or greater than a preset threshold value.

4. The noise cancellation apparatus of claim 3, wherein the parameter estimation unit calculates a forgetting factor of the current frame by cumulatively adding a forgetting factor variation, obtained due to a decrease in the forgetting factor, to a forgetting factor used in the previous frame, and updates noise power using the calculated forgetting factor of the current frame.

5. The noise cancellation apparatus of claim 2, wherein the parameter estimation unit is configured to increase the forgetting factor when the absolute value of the difference between the noise power estimated in the previous frame and the noise power calculated in the current frame is less than the preset threshold value.

6. The noise cancellation apparatus of claim 5, wherein the parameter estimation unit calculates a forgetting factor of the current frame by cumulatively adding a forgetting factor variation, obtained due to an increase in the forgetting factor, to a forgetting factor used in the previous frame, and updates noise power using the calculated forgetting factor of the current frame.

7. The noise cancellation apparatus of claim 1, wherein the parameter estimation unit is configured to, when the signals that are input after being filtered for respective frequencies are continuously input and then the noise power is not updated, decrease the forgetting factor based on duration of continuous input.

8. The noise cancellation apparatus of claim 1, wherein the parameter estimation unit is configured to, when a ratio of signal power calculated in a current frame to a minimum value of signal power is equal to or greater than a preset threshold value, utilize previously estimated noise power.

9. The noise cancellation apparatus of claim 1, wherein the parameter initialization unit is operated in a section in which the reference signals are present, thus determining the initial value of the parameter.

10. A noise cancellation method, comprising:

determining, by a parameter initialization unit, an initial value of a parameter to be used for noise cancellation, based on reference signals filtered for respective frequencies;

receiving, by a parameter estimation unit, the initial value of the parameter, and estimating the parameter in response to signals that are input after being filtered for respective frequencies;

calculating, by a gain estimation unit, gains for respective frequencies based on the estimated parameter; and cancelling, by a gain application unit, noise by applying the calculated gains to the signals that are input after being filtered for respective frequencies, wherein estimating the parameter comprises dynamically determining a forgetting factor based on noise power estimated in response to the signals that are input after being filtered for respective frequencies and estimates the parameter using the forgetting factor, and wherein the signals that are input after being filtered for respective frequencies are signals in a voice signal section other than a section in which the reference signals are present.

11. The noise cancellation method of claim 10, wherein estimating the parameter further comprises, when a ratio of signal power calculated in a current frame to a minimum value of signal power is less than a preset threshold value, determining the forgetting factor using both noise power estimated in a previous frame and noise power calculated in the current frame.

12. The noise cancellation method of claim 11, wherein estimating the parameter further comprises decreasing the forgetting factor when an absolute value of a difference between the noise power estimated in the previous frame and the noise power calculated in the current frame is equal to or greater than a preset threshold value.

13. The noise cancellation method of claim 12, wherein estimating the parameter further comprises calculating a forgetting factor of the current frame by cumulatively adding a forgetting factor variation, obtained due to a decrease in the forgetting factor, to a forgetting factor used in the previous frame, and updating noise power using the calculated forgetting factor of the current frame.

14. The noise cancellation method of claim 11, wherein estimating the parameter further comprises increasing the forgetting factor when the absolute value of the difference between the noise power estimated in the previous frame and the noise power calculated in the current frame is less than the preset threshold value.

15. The noise cancellation method of claim 14, wherein estimating the parameter further comprises calculating a forgetting factor of the current frame by cumulatively adding a forgetting factor variation, obtained due to an increase in the forgetting factor, to a forgetting factor used in the previous frame, and then updating noise power using the calculated forgetting factor of the current frame.

16. The noise cancellation method of claim 10, wherein estimating the parameter further comprises, when the signals that are input after being filtered for respective frequencies are continuously input and then the noise power is not updated, decreasing the forgetting factor based on duration of continuous input.

17. The noise cancellation method of claim 10, wherein estimating the parameter comprises, when a ratio of signal power calculated in a current frame to a minimum value of signal power is equal to or greater than a preset threshold value, utilizing previously estimated noise power.

18. The noise cancellation method of claim 10, wherein determining the initial value of the parameter is performed in a section in which the reference signals are present, thus determining the initial value of the parameter.

* * * * *